United States Patent [19]

Kodama

[11] Patent Number: 4,546,734

[45] Date of Patent: Oct. 15, 1985

[54] HYDRAULIC VALVE LIFTER FOR VARIABLE DISPLACEMENT ENGINE

[75] Inventor: Hisashi Kodama, Nagoya, Japan

[73] Assignee: Aisin Seiki Kabushiki Kaisha, Kariya, Japan

[21] Appl. No.: 609,115

[22] Filed: May 11, 1984

[30] Foreign Application Priority Data

May 13, 1983 [JP] Japan ..... 58-70600[U]

[51] Int. Cl.[4] ..... F02P 13/06

[52] U.S. Cl. ..... 123/90.16; 123/90.27; 123/90.43; 123/90.46; 123/198 F

[58] Field of Search ..... 123/90.15, 90.16, 90.27, 123/90.46, 90.56, 90.57, 198 F, 90.43

[56] References Cited

U.S. PATENT DOCUMENTS

| | | | |
|---|---|---|---|
| 2,745,391 | 5/1956 | Winkler | 123/90.57 |
| 2,948,274 | 8/1960 | Wood | 123/90.56 |
| 3,520,287 | 7/1970 | Calvin | 123/198 F |
| 4,164,917 | 8/1979 | Glasson | 123/90.15 |
| 4,167,931 | 9/1979 | Iizuka | 123/90.27 |
| 4,249,489 | 2/1981 | Bruder et al. | 123/90.27 |
| 4,387,680 | 6/1983 | Tsunetomi et al. | 123/198 F |
| 4,462,353 | 7/1984 | Arai et al. | 123/198 F |

*Primary Examiner*—Ira S. Lazarus

*Attorney, Agent, or Firm*—Finnegan, Henderson, Farabow, Garrett & Dunner

[57] ABSTRACT

A hydraulic valve lifter for variable displacement engine includes a valve housing, one-way valve disposed in the housing for controlling fluid communication between a working chamber and a reservoir, a sleeve member secured to one end of the valve housing and an axial bore therein and a plunger slidably disposed in the axial bore of the sleeve member. The outer diameter of the plunger is designed to be smaller than the inner diameter of the valve housing so that the inertia weight of the plunger may be reduced.

7 Claims, 1 Drawing Figure

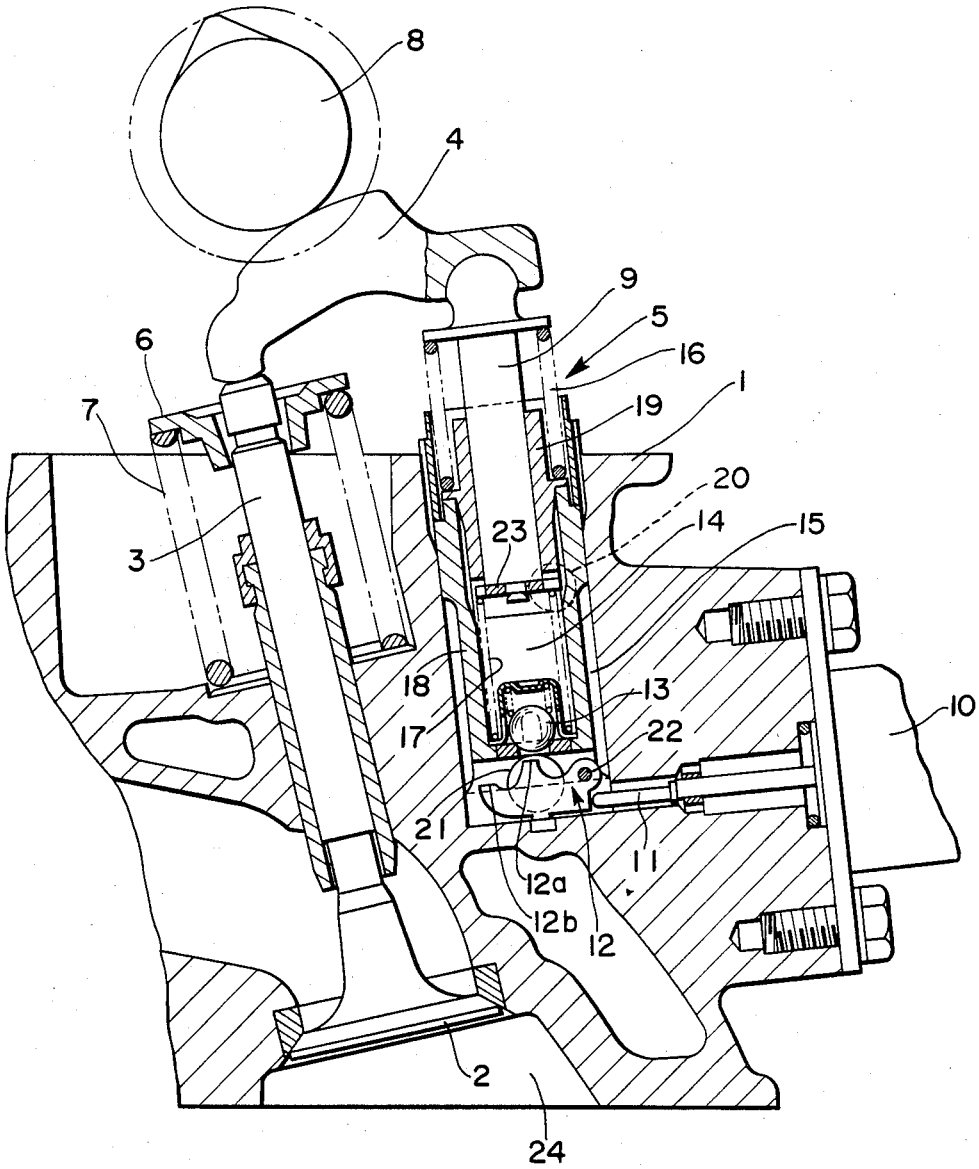
8
4
9
5
16
6
1
19
7
20
14
15
23
3
18
13
10
17
22
21
11
12a
12b
12
2
24

HYDRAULIC VALVE LIFTER FOR VARIABLE DISPLACEMENT ENGINE

BACKGROUND OF THE INVENTION

This invention relates generally to a hydraulic valve lifter, and more particularly, to a hydraulic valve lifter for variable displacement engine of an automobile.

When an automobile with a multi-cylinder engine is running under low load conditions at relatively constant speed or decent of a long hill or during engine deceleration or idling performances, it is unnecessary to operate all of the cylinders of the engine. In order to save fuel consumption, or to improve gas mileage, there have been proposed various type of hydraulic lifters to effectively perform a variable displacement of the multi-cylinder engine.

One of such prior art lifter includes a valve housing, a plunger disposed within a bore of the valve housing and operatively connected to one end of a rocker arm. The plunger is slidably movable within the bore of the valve housing. When the corresponding engine cylinders are not in use due to one of the above conditions of automobile running state, working fluid (oil) of the lifter wll not generate the pressure increase, instead, just allowing the inflow/outflow of the working fluid into and out of working chamber of the lifter.

Such prior art discloses also that the diameters of the plunger and the housing bore are substantially the same, i,e., the outer diameter of the plunger being substantially equal to the inner diameter of the bore of the housing. According to such structure, the amount of hydraulic fluid flow is considerable and the slidable movement of plunger may not be effectively carried out. On the other hand, if the inner diameter of the housing bore is lessened in order to avoid the problems, the size of one-way valve therein should be reduced accordingly, which will not meet the required functions of the one-way valve.

SUMMARY OF THE INVENTION

It is, therefore, an object of the present invention to provide an improved hydraulic valve lifter which obviates above conventional drawbacks.

It is a further object of the invention to provide an improved hydraulic valve lifter which includes a valve housing, a working chamber, a reservoir chamber, a one-way valve disposed within the valve housing for controlling fluid communication between the working and reservoir chambers, a sleeve member secured to an open end of the valve housing and having an axial bore therein, a plunger member slidably disposed in the axial bore of the sleeve member, one end of the plunger disposed in the working chamber and the other end thereof being in co-operative contact with a valve rocker arm, wherein the outer diameter of the plunger is smaller than the inner diameter of the valve housing thereby to reduce the inertia weight of the plunger.

According to the present invention, the valve lifter includes a housing inner diameter of which is larger than the outer diameter of plunger so as to reduce the amount of fluid flow into and out of the working chamber of the lifter.

Further, in this invention, a sleeve member is provided on the housing to differentiate the sizes of diameters of housing bore and plunger.

BRIEF DESCRIPTION OF THE DRAWINGS

The foregoing and other objects, features and advantages of the present invention will be understood more clearly and fully from the following detailed descriptions of a preferred embodiment with reference to the attached drawings in which:

The sole FIGURE shows a cross-sectional view of an embodiment of the present invention.

DETAILED DESCRIPTION OF THE PRESENT INVENTION

In the drawings, numeral 1 designates an engine cylinder head which includes an intake and exhast valve 2. A valve stem 3 of the valve 2 is in contact with one end of a rocker arm 4. The other end of rocker arm 4 is operatively connected to a hydraulic valve lifter 5 as provided according to the present invention. The intake and exhast valve 2 further includes a valve retainer 6 for retaining valve spring 7 which always biases the valve 2 in its closing direction. When a cam shaft 8 is rotated, the rocker arm 4 will be rotated about the contact point with a plunger 9 of the valve lifter 5 as a fulcrum point. In response to the rotational movement of rocker arm 4, the intake and exhaust valve 2 is operated to open or close the combustion chamber 24 of the engine.

When an automobile is running at a constant speed or under a condition that will not need all the engine cylinders to be operated, the valve lifter 5 is actuated to interrupt the open/close operation of the valve 2. When such condition is sensed, a solenoid valve 10 is actuated to move a rod 11 to the left as viewed in the drawings. Then the rode 11 engages with cam member 12 and rotates the same about pin 22.

A central projection **12*a* of the cam member 12 pushes a ball 13 of a one-way valve upwardly to allow fluid communication between a working chamber 14 and a reservoir chamber 15 thereby to generate no pressure increase in the working chamber 14. It should be noted that the biasing force of valve spring 7 is selected to be larger than the total amount of the biasing forces of springs 16 and 17 of the lifter 5. Under the above condition, when the cam shaft 8 is rotated, the rocker arm 4 is rotated about the contact point with the valve stem 3. The rotational movement of the rocker arm 4 moves down the plunger 9 of the valve lifter 5. The plunger 9 moves down within the lifter 5, thereby to give no movement to the valve 2. The lifter 5 further includes a housing 18 having a cylindrical portion therein. The housing 18 is provided on the cylinder head 1 next to the intake and exhast valve 2. A sleeve member 19 is threaded into the inner bore of the housing 18. The plunger 9 is then inserted into a bore of the sleeve member 19 and is axially slidable therein. The upper end of the plunger 9 engages with the end of the rocker arm 4. The outer diameter of plunger 9 may be designed to be smaller than the inner diameter of housing 18. In other words, the inner diameter of housing 18 can be chosen to be any desired size independently of the size of the plunger 9**.

Since the outer diameter of plunger 9 could be reduced, one of the compression springs 16, 17 could be provided at the outer periphery of plunger 9 so that a load applied on the other spring (in this embodiment, 17) could be reduced thereby to enable the fine adjustment of biasing forces of springs.

Numeral 20 designates an inlet for the working fluid (oil) into the working chamber 14, while numeral 21 indicates an outlet for the fluid. A left projection 12*b* of the cam member 12 is for limiting any extra rotational movement of cam member 12 in clockwise direction by engaging with the bottom surface of the housing. Numeral 23 designates a perforated plate retainer secured to the plunger 9 and serves as a spring retainer for spring 17.

It should be understood that preferred embodiment of the present invention has been described herein in detail and that certain modifications, changes, and adaptations may be made by those skilled in the art and that it is hereby intended to cover all modifications, changes and adaptations thereof falling within the scope of the appended claims.

What is claimed is:

1. A hydraulic valve lifter for variable displacement engine comprising:

a hollow valve housing mounted on an engine cylinder head;

a working chamber and a reservoir chamber in said valve housing;

a one-way valve disposed within said valve housing for controlling fluid communication between said working and reservoir chambers;

means for actuating said one-way valve;

a sleeve member secured to an open end of said valve housing and having an axial bore therein; and a plunger member slidably disposed in said axial bore of said sleeve member, one end of said plunger being disposed in said working chamber and the other end thereof being in co-operative contact with a valve rocker arm, wherein an outer diameter of said plunger is smaller than an inner diameter of said valve housing.

2. A hydraulic valve lifter according to claim 1, wherein said valve actuating means includes:

a cam member operatively connected to said one-way valve; and a pair of compression springs disposed in said valve housing.

3. A hydraulic valve lifter according to claim 2, wherein said cam member is actuated to open said one-way valve in response to a signal received by a solenoid valve provided on an engine block.

4. A hydraulic valve lifter according to claim 3, wherein said valve housing is provided in a cavity in said engine cylinder head and wherein said one end of said plunger is in engagement with one end of said rocker arm while the other end of said rocker arm is in contact with an intake and exhast valve.

5. A hydraulic valve lifter according to claim 4, wherein said valve housing includes a cylindrical bore portion and wherein said sleeve member includes a cylindrical portion which is threaded into said cylindrical bore portion of said valve housing.

6. A hydraulic valve lifter according to claim 2, wherein one of said pair of springs is disposed at an outer periphery of said sleeve member and the other of said pair of springs is disposed within said valve housing.

7. A hydraulic valve lifter according to claim 6, wherein said pair of springs biase said plunger in one direction.

* * * * *